United States Patent [19]

Ebata

[11] 4,333,283

[45] Jun. 8, 1982

[54] DOUBLE SASH STRUCTURE

[75] Inventor: Hiroyuki Ebata, Uozu, Japan

[73] Assignee: Yoshida Kogyo K.K., Tokyo, Japan

[21] Appl. No.: 89,310

[22] Filed: Oct. 30, 1979

Related U.S. Application Data

[63] Continuation of Ser. No. 863,581, Dec. 22, 1977, abandoned.

[30] Foreign Application Priority Data

Dec. 29, 1976 [JP] Japan ..... 51/178687[U]

[51] Int. Cl.[3] ..... E06B 3/26; E06B 1/32; E06B 1/26

[52] U.S. Cl. ..... 52/202; 49/63; 49/504; 49/DIG. 2

[58] Field of Search ..... 52/202, 204, 403, 211; 49/63, 404, 501, 504, 409, 410, 411, 103, DIG. 1, DIG. 2; 160/90, 91

[56] References Cited

U.S. PATENT DOCUMENTS

| | | | |
|---|---|---|---|
| 3,023,465 | 3/1962 | Sconzo | 49/455 X |
| 3,436,884 | 4/1969 | Bell et al. | 52/202 |
| 3,600,857 | 8/1971 | La Barge | 52/403 X |
| 3,859,754 | 1/1975 | Budich et al. | 49/504 X |
| 3,919,815 | 11/1975 | Alabaster | 52/204 X |
| 3,984,954 | 10/1976 | Takeda | 52/202 |
| 3,992,815 | 11/1976 | Potter | 52/202 X |
| 4,048,774 | 9/1977 | Yamamoto | 52/202 |

*Primary Examiner*—J. Karl Bell

*Attorney, Agent, or Firm*—Hill, Van Santen, Steadman, Chiara & Simpson

[57] ABSTRACT

In a double sash structure comprising a first sash facing to the outside and a second sash facing to the inside, a window frame of the first sash is formed of a metallic material and a window frame of the second sash, which is formed of a non-metallic material having a low heat conductivity, is disposed contiguously to the window frame of the first sash. By virtue of the low heat conductivity of the window frame of the second sash, lowering of the temperature in the room and formation of dew by condensation of moisture can be prevented. Accordingly, a double sash structure excellent in the heat-insulating property and having a beautiful appearance and an improved strength, which can be readily assembled, can be provided.

6 Claims, 5 Drawing Figures

DOUBLE SASH STRUCTURE

This is a continuation of application Ser. No. 863,581, filed Dec. 22, 1977, now abandoned.

BACKGROUND OF THE INVENTION (1) Field of the Invention

The present invention relates to a double sash or window structure comprising a window frame for a first sash disposed on the outdoor side and a window frame for a second sash disposed on the indoor side.

(2) Brief Description of the Prior Art

Double sash structures comprising a window frame for a first sash disposed on the outdoor side, a window frame for a second sash disposed on the indoor side and a heat-insulating material interposed between the two window frames are known. In conventional double sash structures having the above-mentioned structure, connecting portions are formed on connecting ends of both frames and these portions are combined together through an intermediate heat-insulating member. Accordingly, the assembling and attaching operations are very troublesome.

Since the window frames and frames of screens are ordinarily formed of metallic materials in conventional double sash structures, the heat of warmed air in the room escapes to the outside through the window frames and screens and cold air outside the room cools air in the room through the window frames and screens. Accordingly, the intended effects of the double sash structure cannot be attained sufficiently. Moreover, condensed water dews are generated because window frames on the indoor side are cooled, and the interior of the room is readily contaminated with these condensed water dews. These are defects involved in the conventional double sash structures.

OBJECTS OF THE INVENTION

The present invention is to eliminate the foregoing defects involved in conventional double sash structures. More specifically, it is a primary object of the present invention to provide a double sash structure in which cooling of air in the room by air in the outside through window frames is effectively prevented and the window frames on the indoor side are always maintained at room temperature or a temperature approximating thereto to thereby prevent formation of condensed water dews and contamination of the interior of the room therewith, and in which the intended effects of the double sash structure can be attained sufficiently.

Another objects of the present invention is to provide a double sash structure which can be assembled and attached very easily.

Still another object of the present invention is to provide a double sash structure which has a good appearance and is very tough and strong though a window frame of a non-metallic material is used.

BRIEF SUMMARY OF THE INVENTION

The present invention is characterized in that an ordinarily used metal sash is used as a first sash to be disposed on the outdoor side, a sash formed of a non-metallic material having a low heat conductivity is used as a second sash to be disposed on the indoor side, and both sashes are combined with each other by utilizing fitting portions or by using an adhesive or screw according to need.

DETAILED DESCRIPTION OF THE PREFERRED EMBODIMENTS

Figure 1:
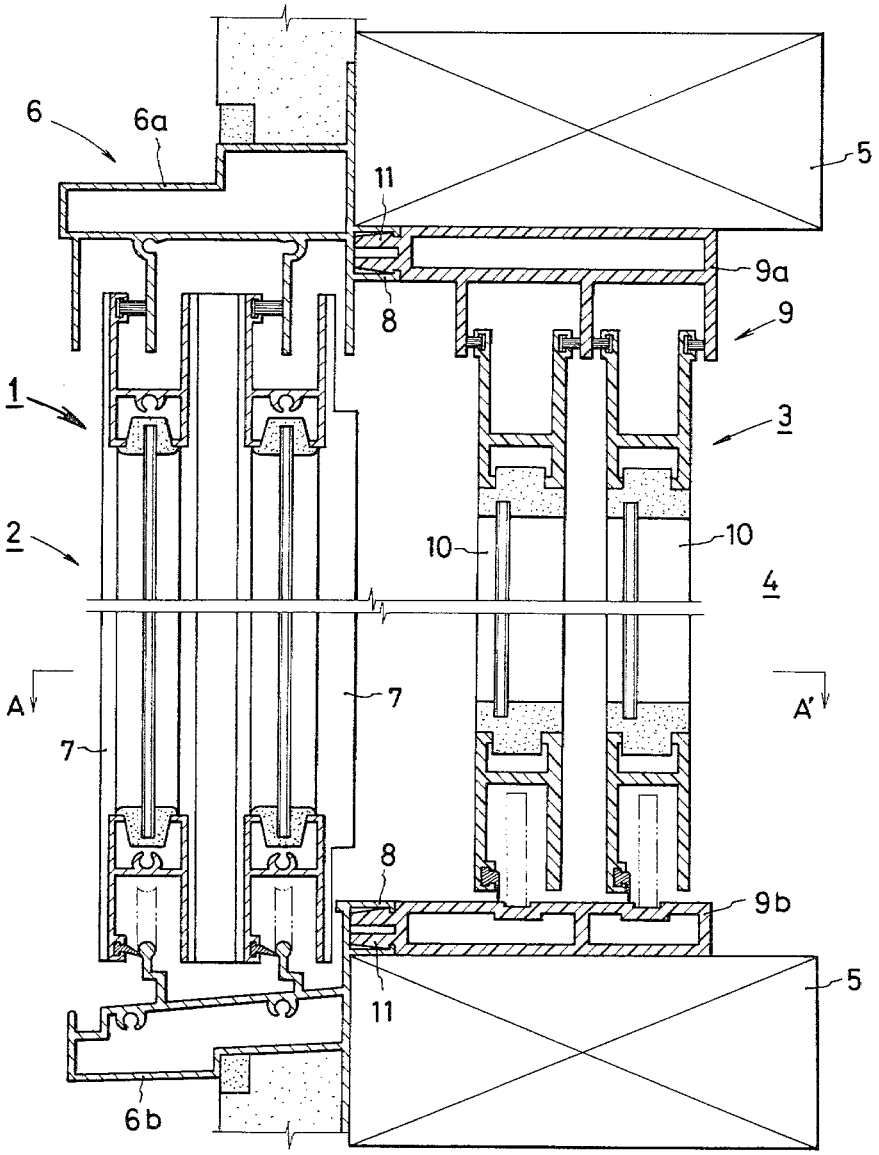
FIG. 1 is a sectional side view, illustrating a double sash structure according to a first embodiment of the present invention.

The present invention will now be described in detail by reference to embodiments illustrated in the accompanying drawings.

A double sash structure 1 of the present invention comprises a first sash 2 disposed on the outdoor side and a second sash 3 disposed on the indoor side. The first sash 2 is supported in a first window frame 6 projected to the outdoor side of a constructional member 5 defining an opening 4 and first screens 7 slung into the first window frame in the staggered state. The first window frame 6 consists of an upper frame 6*a*, a lower frame 6*b* and vertical frames 6*c* disposed on both the sides, each being formed of a metallic material such as aluminum. An engaging portion 8 projected into the opening 4 is formed on the indoor side end of each of these upper, lower and vertical frames 6*a*, 6*b* and 6*c*. The engaging portion 8 is formed to have a lip-groove like section opened to the indoor side, and one side face of the engaging portion 8 is disposed along the constructional member 5.

The first screens 7 having sash frames composed of metallic material such as aluminum are slung in the staggered state into the first window frame 6 having the above-mentioned structure.

The second sash 3 is supported in a second window frame 9 disposed in the opening 4 (on the indoor side) contiguously to the first window frame 6 and second screens 10 slung into this second window frame 9 in the staggered state.

The second window frame 9 consists of an upper frame 9*a*, a lower frame 9*b* and vertical frames 9*c* disposed on both the sides, each being composed of a non-metallic material having a low heat conductivity, such as a synthetic resin. An engaging portion 11 capable of being engaged with the above-mentioned engaging portion 8 formed on the first window frame 6 is formed on the outdoor side end of each of the upper, lower and vertical frames 9*a*, 9*b* and 9*c*. Each engaging portion 11 is intruded in and engaged with the corresponding engaging portion 8 to connect the first window frame 6 and the second window frame 9 integrally or securely to each other.

The second screens 10 having sash frames composed of a non-metallic material having a low heat conductivity, such as a synthetic resin, are slung in the staggered state into the second window frame 9 having the above-mentioned structure.

Ordinary molding synthetic resin materials are preferably used as materials constituting the second window frame 9 and second sash 3. For example, there can be preferably employed polyamide type polymers, polyester type polymers, ABS resins, hydrocarbon type polymers, mixtures and copolymers thereof, polyacetals and thermosetting resins.

At the operation of assembling the double sash structure of the present invention, the engaging portion 8 of the first window frame 6 is first engaged with the engaging portion 11 of the second window frame 9 to connect the first window frame 6 to the second window frame 9. Then, the second window frame 9 is set in the opening 4 and the first window frame 6 is arranged on the outdoor side of the constructional member 5. In this state, both window frames 6 and 9 are attached to the opening 4.

Then, the first screens 7 and second screens 10 are slung into the first window frame 6 and second window frame 9, respectively, in the staggered state.

Incidentally, the second window frame 9 may be inserted from the indoor side of the opening 4 into the first window frame 6 projected to the outdoor side of the constructional member 5 and in this state, the engaging portion 11 may be inserted in and engaged with the engaging portion to fix or secure both the window frames 6 and 9.

Since the second window frame is formed of a non-metallic material having a low heat conductivity, such as a synthetic resin, even if the first window frame is formed of a metallic material, cold air outside the room is insulated by the second window frame, and therefore, the degree of cooling of air in the room is remarkably reduced and the heat-insulating effect of the double sash structure can be sufficiently manifested. Moreover, since the second window frame formed of a synthetic resin or the like is connected to the metallic first window frame and is reinforced thereby, the strength of the second window frame can be enhanced. Furthermore, the first and second window frames can readily be assembled by engaging the engaging portions formed on the respective window frames with each other, and therefore, the assembling and attaching operations can be remarkably facilitated.

Figure 2:
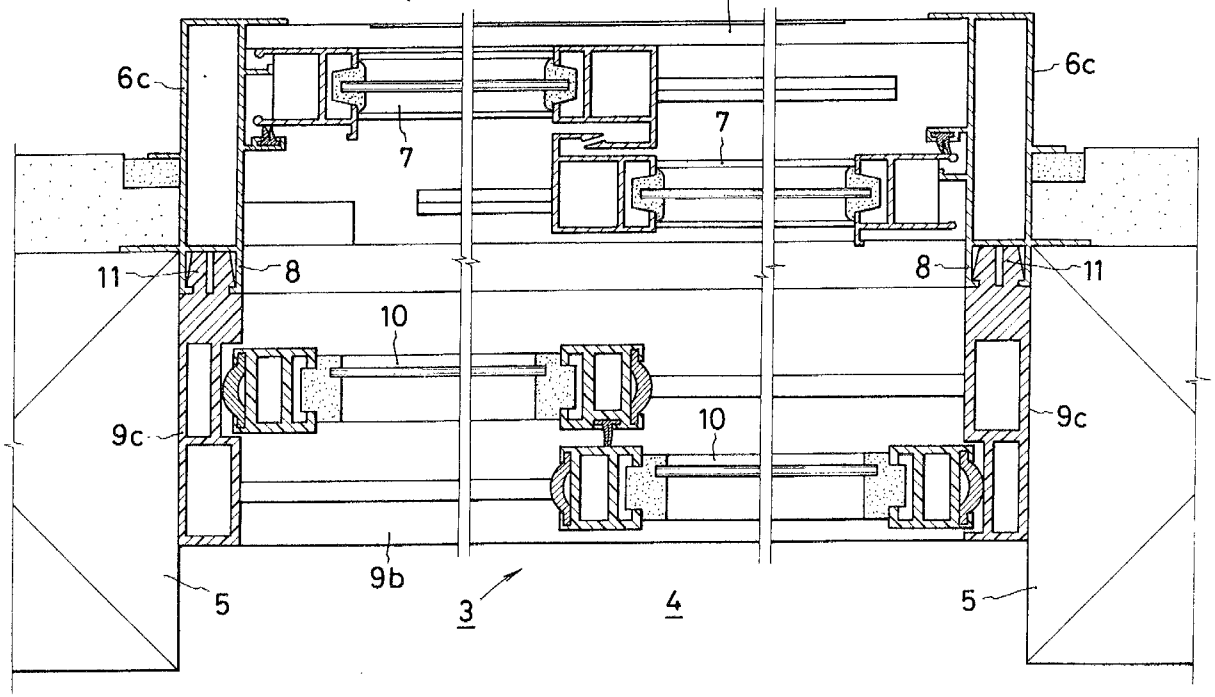
FIG. 2 is a sectional plan view of the double sash structure of FIG. 1, showing the section taken along the line A—A' in FIG. 1.
Figure 3:
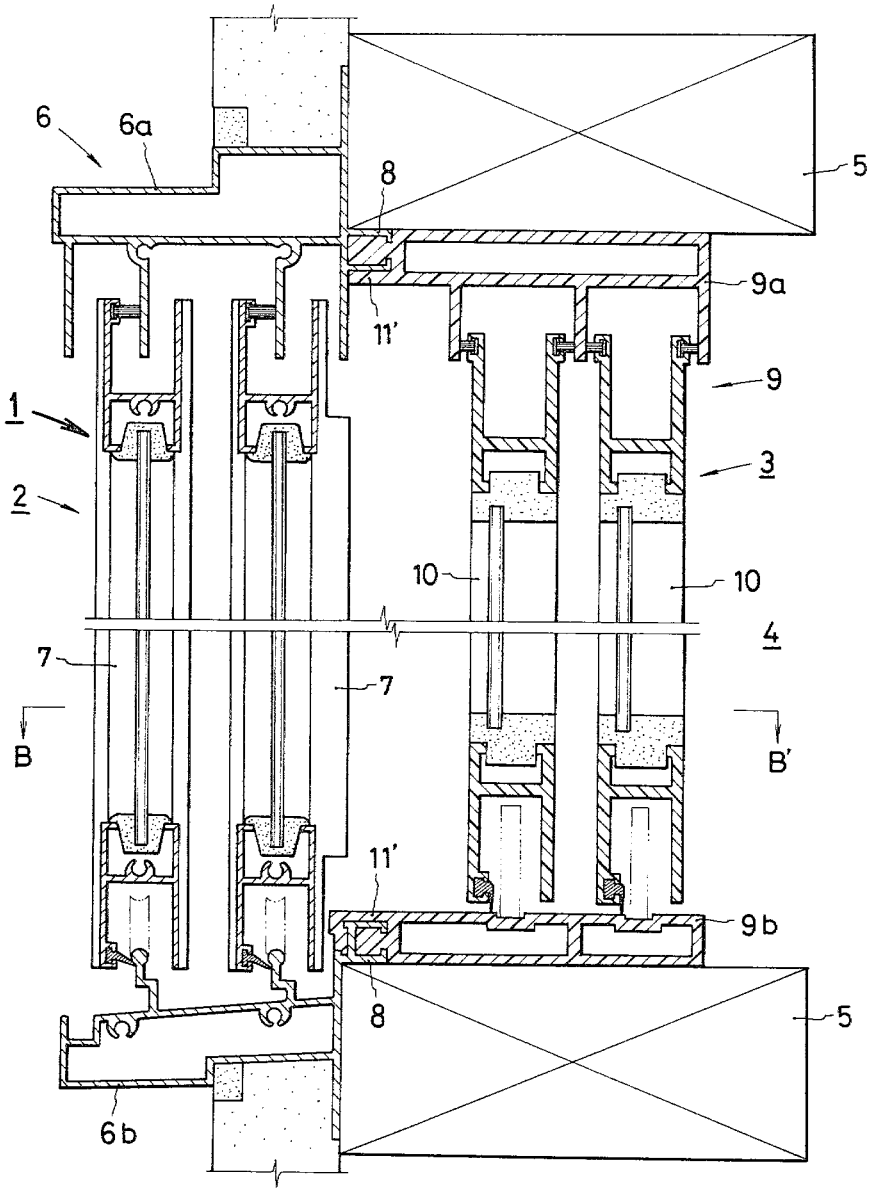
FIG. 3 is a sectional side view, illustrating a double sash structure according to a second embodiment of the present invention.
Figure 4:
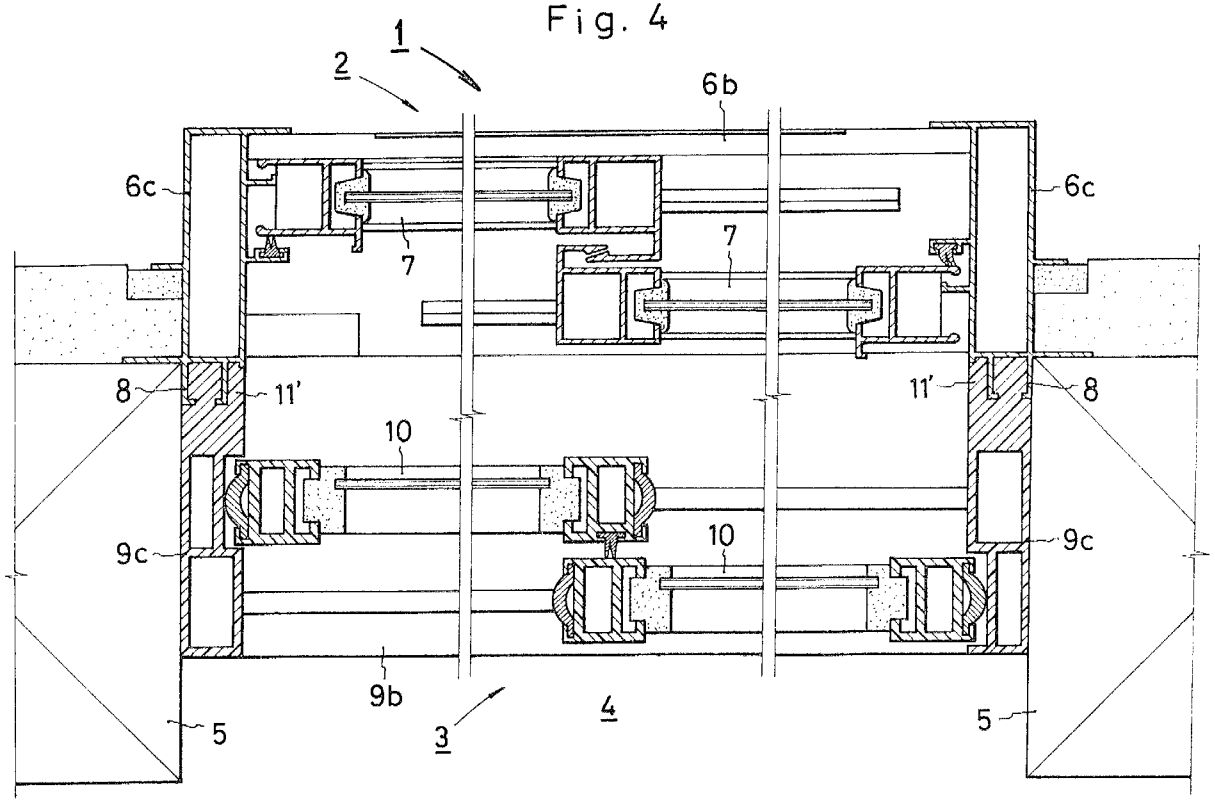
FIG. 4 is a sectional plan view of the sash structure of FIG. 3, showing the section taken along the line B—B' in FIG. 3.

In the second embodiment of the double sash structure of the present invention shown in the sectional views of FIGS. 3 and 4, the engaging portions connecting the first and second window frames have a structure different from the structure of the engaging portions in the above-mentioned first embodiment. More specifically, although the shape of the engaging portion 8 of the first window frame 6 in the present embodiment has a lipped groove configuration in section, the same as that in the first embodiment shown in FIGS. 1 and 2, the engaging portion 11' of the second window frame 9 is formed so that it covers the surface of the first engaging portion 8.

When the first window frame 6 is coupled with the second window frame 9, in the state where the engaging portion 11' is fitted in the engaging portion 8 from the longitudinal direction thereof, the upper frame 9*a*, lower frame 9*b* and vertical frames 9*c* of the second window frame 9 are respectively inserted.

Figure 5:
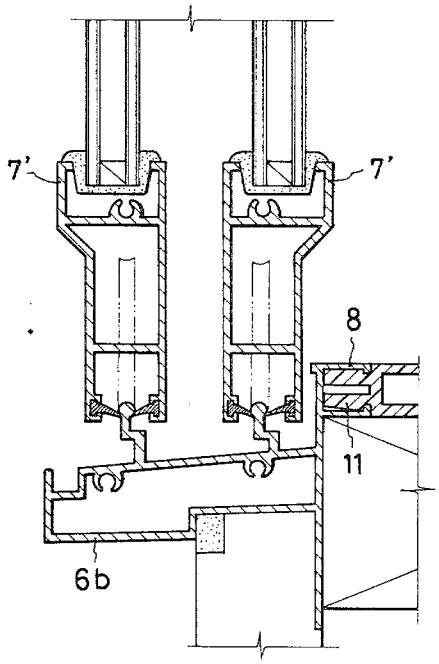
FIG. 5 is a sectional side view, illustrating a part of a double sash structure according to a third embodiment of the present invention, which includes a multi-layer glass screen.

In the third embodiment of the double sash structure of the present invention shown in the sectional view of FIG. 5, first screens 7' including so-called multi-layer glass composed of a plurality of glass sheets arranged at optional intervals are used instead of the first screens 7 used in the foregoing embodiments.

In this arrangement, the heat-insulating effect can be remarkably improved, and also the sound-insulating effect can be enhanced.

In each of the foregoing embodiments, the first window frame 6 is securely connected to the second window frame 9 by coupling the engaging portion 8 contiguously with the engaging portion 11 or 11'. Of course, the first window frame 6 may be directly connected to the second window frame 9 contiguously thereto by using an adhesive.

As will be apparent from the foregoing illustration, in the double sash structure of the present invention, since the window frame for the second sash located on the indoor side is formed of a non-metallic material having a low heat conductivity and disposition of a heat-insulating member as used in the conventional double sash structures is omitted, the assembling and attaching operations can be remarkably facilitated.

Still further, among window frame portions which can conduct the outdoor temperature into the inside of the room most readily in parts of the double sash structure, the window frame portions of the second sash located on the indoor side are formed for a non-metallic material having a low heat conductivity. Therefore, escape of the heat of air in the room or cooling of air in the room by cold air present outside the room is effectively prevented and a sufficient heat-insulating effect can be attained. Moreover, formation of condensed water dews contaminating the interior of the room is prevented.

When frames of screens of the second sash are formed of a non-metallic material, the heat-insulating effect can be further enhanced, and no metallic cold feeling is given and a good appearance can be imparted to the double sash structure.

Still in addition, when the screens of the first sash are formed of a metallic material, the mechanical strength improving effect can be attained besides the above-mentioned effects, and the weather resistance of the double sash structure can be remarkably enhanced.

What is claimed is:

1. A double sash structure for attachment in and around an opening in a room structure, a first window frame supporting said first sash and having first engagement means integral therewith, a second sash disposed on the indoor side of the room structure, and a second window frame supporting said second sash and having second engagement means integral therewith adapted for positive coupling with said first window frame, said first window frame and said first sash being formed of a metallic material and said second window frame and second sash a synthetic resin material having a low heat conductivity, said first and second engagement means each comprising a projecting engagement member extending toward the other and operative upon attachment of said second frame to said first frame to securely fix the first and second frames together.

2. A double sash structure according to claim 1, wherein a screen of the first sash consists of a multi-layer of glass comprising a plurality of glass sheets arranged at optional intervals.

3. A double sash structure according to claim 1, wherein said first engagement means of the first window frame includes spaced first and second lips and said second engagement portion of the second window frame has a projection for insertion and positive support between said first and second lips from the indoor side of the structure.

4. A double sash structure according to claim 3, wherein said projection of the second engagement portion of the second window frame has a relief groove provided in the longitudinal direction thereof, whereby when the projection is inserted between the first and second lips of the first window frame it can flex to narrow said groove.

5. A double sash structure according to claim 1, wherein said engaging portion of the second window has an extending portion thereof projecting over an outer surface portion of the engaging member of the first window frame.

6. A double sash structure according to claim 5, wherein in coupling said second window frame with said first window frame, the former can be inserted in the longitudinal direction of the structure prior to insertion of the second window frame into the opening.

* * * * *